US006006511A

United States Patent [19]

Hofmann et al.

[11] Patent Number: 6,006,511

[45] Date of Patent: Dec. 28, 1999

[54] SEPARATING ROLL FOR AN OPEN END SPINNING MACHINE

[75] Inventors: Eberhard Hofmann; Klaus Schoberth, both of Ingolstadt; Christian Göbel, Weichering, all of Germany

[73] Assignee: Rieter Ingolstadt Spinnereimaschinenbau AG, Ingolstadt, Germany

[21] Appl. No.: 09/031,079

[22] Filed: Feb. 26, 1998

[30] Foreign Application Priority Data

Feb. 28, 1997 [DE] Germany ..... 197 08 190

[51] Int. Cl.[6] ..... D01H 4/00

[52] U.S. Cl. ..... 57/408; 19/112; 19/113; 19/114

[58] Field of Search ..... 57/408; 19/112, 19/113, 114; 492/44

[56] References Cited

U.S. PATENT DOCUMENTS

| | | | |
|---|---|---|---|
| 3,833,968 | 9/1974 | Arai et al. | 19/114 |
| 3,853,494 | 12/1974 | Graf | 19/114 |
| 4,169,019 | 9/1979 | Motobayashi et al. | 19/114 |
| 4,352,224 | 10/1982 | Grimshaw et al. | 19/112 |
| 4,862,688 | 9/1989 | Schmolke | 57/408 |
| 4,882,812 | 11/1989 | Fetzer et al. . | |
| 5,085,047 | 2/1992 | Hofmann . | |
| 5,164,236 | 11/1992 | Schmid | 57/408 |

FOREIGN PATENT DOCUMENTS

| | | | |
|---|---|---|---|
| 1993868 | 9/1968 | Germany . | |
| 2433769 | 1/1976 | Germany . | |
| 2904841 | 8/1980 | Germany . | |
| 4038352A1 | 6/1992 | Germany . | |
| 4010680A1 | 7/1992 | Germany . | |
| 59-94623 | 5/1984 | Japan | 19/114 |
| 60-99017 | 6/1985 | Japan | 19/114 |
| 60-224820 | 11/1985 | Japan | 19/114 |
| 61-6320 | 1/1986 | Japan | 19/114 |
| 61-34233 | 2/1986 | Japan | 19/114 |
| 1362602 | 8/1974 | United Kingdom . | |
| 1375772 | 11/1974 | United Kingdom . | |
| 2146669 | 4/1985 | United Kingdom | 19/114 |

OTHER PUBLICATIONS

European Patent Office Search Report, Feb. 25, 1999.

Patent Abstract of Japan, Publication No. 03019922, Jan. 29, 1991.

German Patent Office Search Report, May 20, 1997.

*Primary Examiner*—William Stryjewski
*Attorney, Agent, or Firm*—Dority & Manning

[57] ABSTRACT

For a separating roll, which finds application on an open end spinning machine, the proposal is made that a spiral trim wire be preformed and precoated before the trim wire is installed upon the circumference of the roll. In this way, separating rolls of the most varying materials may be employed since the rolls themselves need not undergo the coating process. Further, the trim wire may be preformed into a spiral before fitting on the separating roll. Moreover, a process for the production of the trim wire is presented. During the process of coating, the preformed spiral windings are held at an axial distance from one another.

22 Claims, 2 Drawing Sheets

SEPARATING ROLL FOR AN OPEN END SPINNING MACHINE

DESCRIPTION

The present invention concerns a separating roll for an open end spinning machine. The varied types of separating rolls for open end spinning machines have been made public knowledge by the present state of the technology. A separating roll has been made known by DE-A 24 33 769 in which a trim wire, helicoidally shaped and stress formed, is installed on the outer surface of the separating roll and affixed thereto. By this means, it should be possible to employ a harder trim wire. U.S. Pat. No. 5,085,047 teaches of a separating roll in which the carrier is produced by pressure casting, or is generated by extrusion pressing. The carrier bears on its circumferential surface, teeth for the separation of fiber strings into single fibers. These teeth are formed by means of the use of a trim wire wound helicoidally on said surface. The trim wire in this process is deformed and wound under tension onto the carrier. In order to provide a sufficient stability for the reception of the trim wire which is under tension, ribs are formed on the carrier which, in turn, is supported radially on a hub.

In the case of other separating rolls, the carrier is constructed in the shape of a ring, which is affixed to the axle borne by the separating roll bearing, and which, with a cover, forms the separating roll. The separating appurtenance is then in the shape of a helicoidally drawn trim wire. Carriers, in the present state of the technology, are mainly comprised of alloys of light metals, which are easy to produce and work. Known also are carriers made of thin walled steel rings.

The trim wire, in conventional practice, is comprised of a hardened steel, so that generally the requirements are met for abrasion wear in the handling of cotton fiber. In case a greater resistance to abrasion is required, a known practice includes the encapsulation of the entire separating roll with an abrasion resistance coating.

In most instances, this is brought about by a process in which the separating roll is immersed in a coating bath, in which bath is to be found hard particulate, for instance, diamond fines, which attach to the separating roll whereby the abrasion resistance of said roll is markedly increased.

Conventional separating rolls, which are to be coated in order to achieve a sufficient abrasion resistance, place, however, special demands on construction design which leads to increased costs and more complex manufacturing procedures. Therefore, separating rolls of pressurized casting origin have the disadvantage that their exposed surface is porous and upon coating in multiple baths, remainders of a bath remain behind in the pores, whereby a contamination of the coating bath by the preceding bath occurs. A further disadvantage is that, besides the teeth application, also other parts of the separating roll are coated, even though this is not required and in some cases is undesirable. This disadvantage brings with it a greater consumption of the coating material which, as a result, raises the costs unnecessarily. Moreover, it can become necessary that the separating rolls be subjected to heat treatment after the coating. When this is done, one can expect that there will arise deformation of the separating rolls, or in some cases the carrier. Such deformation is caused by residual tensions in the carrier or by the trim wire itself. An installation of a carrier made of plastic is generally impossible.

OBJECTS AND SUMMARY OF THE INVENTION

Thus, a purpose of the present invention is then to design a separation roll of such a kind that the disadvantages of the current state of the technology are avoided and a simple, economical construction of the separating roll is achieved. Also, an object of the invention is to provide a high abrasion resistance of the separation roll, without providing the entire separation roll with a protective coating. A further purpose is to present a process for the production of a trim wire for such a separating roll. Additional objects and advantages of the invention will be set forth in part in the following description or may be obvious from the description, or may be learned through practice of the invention.

Because of the fact that the separating roll, in accord with the invention, is fitted with a trim wire, which trim wire had been coated before installation, an achievement has made that the separating roll itself need not be coated. This has the advantage that only the trim wire itself is subjected to the coating procedure as well as the operations connected therewith, notably temperature treatments. The separating roll itself, or when this is of multicomponent construction, then the carrier, can then be made of less expensive material and less stable composition. This is further supported in that the trim wire is already preformed before the coating, so that the installation the trim wire brings about no stresses affecting the carrier or the separation roll. In this way, a deformation of the carrier cannot happen when this is composed of low priced material, for instance plastic, or a material less rigid or very thin walled.

The separation roll formulated in accord with the invention possesses, moreover, the advantage that in its installation on the separation roll, the trim wire need not be deformed anymore so that it may consist of very hard and brittle steel. Not only this, but even a brittle coating can be employed and no reservations must be made in regard to the thickness of said coating. If a trim wire be used in accord with the invention, that is provided with a pre-applied, abrasion resistant coating, no concern has to be given as to whether the remaining parts of the separation roll are incompatible with the coating procedure or with the medium used for the coating. Those components made by aluminum pressure casting which are commonly used for the separation roll, show a fine porosity which, for instance, lead to contamination when exposed to chemical coating baths. These problems do not arise with separation rolls manufactured in accord with the invention, and once again the known pressure cast components can be used.

Through the preformation process, the trim wire can advantageously be fully hardened, that is, not only the teeth, as was common with the conventional trim wires, but also the footings of the teeth. Upon the fitting of the trim wire on the separation roll or the carrier, it does not have to suffer deformation, so that even a trim wire with a high degree of hardness and brittleness can be employed. This has the great advantage that the former severe erosion experienced in the zone of the foot of the tooth can be greatly reduced.

The deformation of the trim wire comes about in such a way that the trim wire, in that surface in which the teeth lie, is bowed. Upon the installation of the trim wire on the separation roll, the zone of the tooth feet is practically not distorted. It is particularly of advantage if the trim wire is so preshaped that it already possesses an inside diameter which is equal to or greater than the diameter of its cylindrical reception means on the carrier. Thereby, it is guaranteed that the trim wire can be easily drawn onto the carrier. It is advantageous if the single loops of the trim wire possess equal diameters. In the case of another favorable embodiment, the deformation of the trim wire is carried out on a dimensioned winding body, wherein the inside diameter of a helicoidal winding of the trim wire is smaller than the diameter of the cylindrical reception surface of the carrier. What is gained by this is that the application of the teeth to the separation roll is especially simple since, especially when a grooving has been made on the carrier for the insertion of the trim wire, the trim wire can easily be installed therein. By means of its smaller diameter, the trim wire tends to lay itself within the groove of the carrier without external pressure.

A ratio of the inside diameter of a winding of the preformed trim wire to the diameter of its cylindrical receiving surface showing a value of less than 1.4 has proved itself to be particularly favorable. This value assures that the trim wire can be mounted in practically a normal way since it can be easily drawn over the separation roll and further, by this fitting, only a slight deformation is necessary for insertion in the groove of the trim wire receiving area or placement on the surface of the receiving area.

A particularly favorable value of the given ratio lies between 1.2 and 0.8, and a value of between 1.1 and 0.9 has shown itself to be ideal.

In the case of a further advantageous enhancement of the invention, the trim wire is not only coated before it is drawn upon the carrier, but is also heat treated. This enables the coating to be completed in a comprehensive manner, so that when the trim wire is drawn onto the separation roll, this roll requires no further treatment steps.

It is advantageous if the trim wire be drawn onto the separation roll in an axial direction because, by this means, grooving for the reception of the trim wire can be omitted. It is particularly advantageous if the trim wire possesses a foot which has an axial extension which is greater than the axial extension of the teeth, so that upon a placement of the trim wire, foot to foot, without the use of grooving, a perfect seating of the effective teeth is achieved. By means of a favorable formation of the separation roll with a grooving for the reception of the trim wire, the advantage lies therein that a simple trim wire can be used and, in spite of this, the axial spacing of the trim wire is equal. It is advantageous if the axial breadth of this grooving has a value greater than the axial breadth of the trim wire, but at the same time less than the axial breadth of the trim wire plus 0.2 mm. Thereby, sufficient space is created to assure that the coating on the trim wire is not displaced upon the insertion of the trim wire.

In an advantageous development of the invention, provision is made that the carrier is designed as a ring and has a wall thickness between 1 mm and 5 mm. Besides other favorable coatings of the trim wire, a trim wire is particularly advantageous which is chemically coated with nickel, wherein hard material particulate is embedded in the nickel layer. Besides a good resistance to abrasive wear, the separation roll so designed shows good characteristics for the separation of the fibers.

In accord with the invention, in the shaping of a trim wire following the coating, no further deformation of the trim wire can be allowed to occur before its installation. This guards against damage to the said coating. Abrasion resistant coatings would simply flake off or be damaged if, immediately following the coating, the trim wire is wound into a spiral shaped form. Where windings are arranged with axial spacing between one another, then the coating procedure proceeds with uniformity. If the trim wire lies as a free spiral upon coating, then the trim wire is coated from all sides in equal measure.

In the following description, with the help of drawings, the invention is further described:

DETAILED DESCRIPTION

Figure 1:
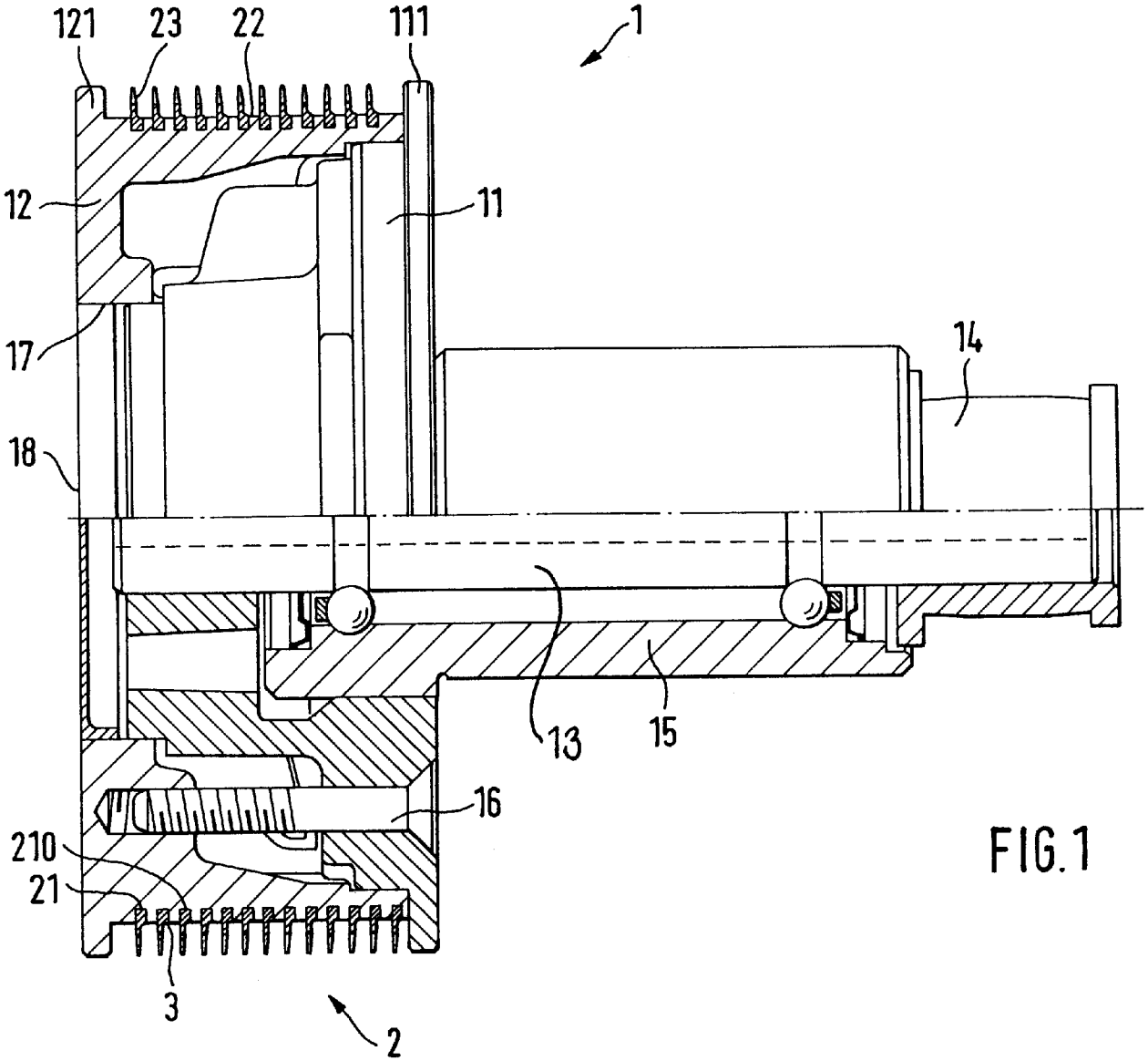
FIG. 1 shows a separation roll with its bearing, partially in section.

Reference will now be made in detail to the presently preferred embodiments of the invention, one or more examples of which are illustrated in the drawings. Each example is provided by way of explanation of the invention, and not as a limitation of the invention. In fact, features illustrated or described as part of one embodiment can be used with another embodiment to yield still a further embodiment. It is intended that the invention include such modifications and variations as come within the scope and spirit of the invention.

FIG. 1 shows a plan view, partially in section, of a separation roll in accord with the invention. The separation roll 1 is comprised of a core piece 11, which circumferentially accepts a carrier 12. The core piece 11 is affixed to shaft 13 by means of press fitting. By means of shaft 13, the separation roll is carried in bearings 15. The shaft 13, and thus the separation roll 1, is driven by means of a belt (not shown). The belt operates on the sheave 14 on the shaft 13. The core piece 11 and the carrier 12 are bound together by means of screws 16. The carrier possesses a concentric circular opening 17 which is closed by a cover 18.

The carrier 12 bears around its circumferential surface a holder 2 which is provided for tooth set 23. This arrangement separates fiber strings into individual fibers in a manner known in the art of open end spinning machines. For the acceptance of holder 2 for the tooth set 23, the separation roll 1 possesses, as seen in FIG. 1, the carrier 12, a grooving 21 which is inscribed in the surface of the cylindrical circumference 22 of the carrier 12. The groove 21 is spirally shaped about said circumferential surface 22 and extends from the flange 121 of the carrier 12 to the zone of the flange 111 of the core piece 11.

The trim wire 3 is, in conformity with the invention, preliminarily spirally shaped and pre-coated and, in this prepared condition, is laid into the groove 21 of the separation roll 1. The trim wire 3 bears teeth 23, which, by means of the concept of the separation roll 1 in accord with the invention, are especially designed to be abrasion resistant. The base of the groove 21 forms the recess 210 to accept the trim wire 3, which is thereupon inlaid. For the fastening of the trim wire 3 onto the separation roll 1, the wire is advantageously neither clamped nor tamped in.

This latter clamping and tamping is known in the conventional state of the technology for separation rolls. In accord with the invention, the affixing is achieved through the correlation of the diameter of the recess 210 in connection with the design of the inside diameter of the windings of the preformed trim wire 3. Thus, the trim wire 3 remains securely within the groove 21 without the necessity of further fastening means. To enable this, the inside diameter of the preformed trim wire is made smaller than its receiving recess 210. The axial extension of the groove 21, that is the breadth thereof, requires no clamping action in a case of this design (ratio of inside diameter of preshaped trim wire 3 to the diameter of the receiving recess 210). In a case wherein the prefashioned trim wire 3 possesses a greater inside diameter than the diameter of the receiving recess 210, it can be advantageous if the trim wire 3, inclusive of its coating, is broader than the breadth of the groove 21. By this means, a secure fastening of the trim wire 3 can be achieved onto the separation roll 1 without a peening of the ends of the trim wire 3 to the separation roll 1, which is a customary practice in the current state of the technology. Obviously, it is also possible that a secure hold of the trim wire 3 onto the separation roll 1 can be achieved by a special design of the inner diameter of the trim wire and additionally if the trim wire 3, including its coating, is broader than the breadth of the groove 21. Care must be taken, however, that upon the installation of the trim wire 3 on the separation roll 1, the trim wire 3 has not been so greatly expanded that thereby the coating is damaged or destroyed through too great a deformation. Likewise, the breadth of the trim wire 3 is relation to the breadth of the groove 21 is to be so chosen, that in spite of desired clamping action, there will be an avoidance of damaging the trim wire 3, or the coating thereof, when said trim wire 3 is laid into the groove 21. The different modes of coating have different sensitivities. Thus, for instance a coating which is applied by nitriding, is less sensitive than a coating of chemically deposited nickel with hard material inclusions, for instance, diamond fines or silicon carbide particulate.

Moreover, it is also possible, especially when the ratio of the inside diameter of the trim wire 3 to the diameter of the recess 210 is greater than 1, that the trim wire, as has been customary in the present conventional state of the technology, is firmly clamped to the separation roll 1 by a deformation of the sides of the groove 21.

Figure 2:
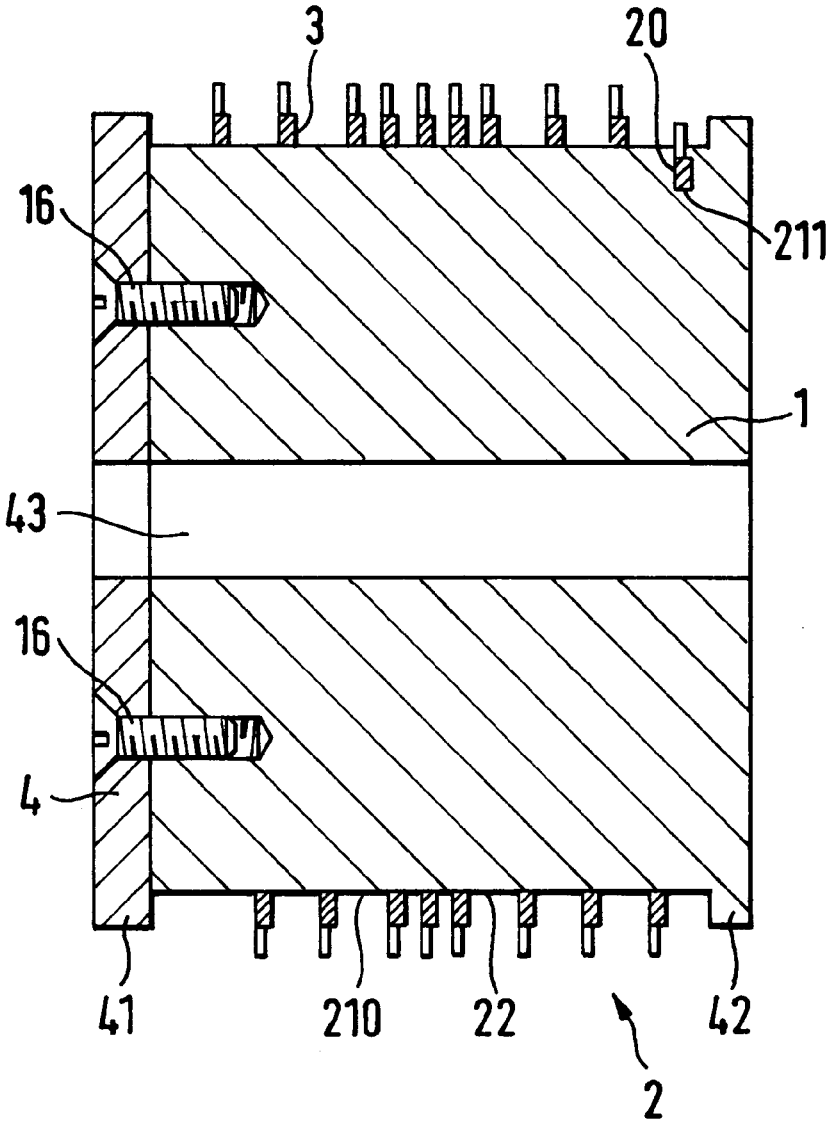
FIG. 2 shows a single piece separation roll in section.

FIG. 2 depicts a sectional presentation of a separation roll 1, which is designed as one piece and has one side closed by a cover 4. The cover 4 comprises, because of its greater diameter than the separation roll 1 itself, also the flange 41. The other flange 42 is integral with the separation roll 1. In the center, the separation roll 1 possesses a boring 43, with which it is affixed to a shaft in similar manner as the multi-component separation roll 1 of FIG. 1. The cover 4 is securely fastened to the separation roll 1 by screws 16. For the acceptance of the trim wire 3, the outside surface 22 of the separation roll 1 simultaneously plays the role of the recess 210 for the trim wire 3 of FIG. 1. Further, this surface is not grooved, as is the case in FIG. 1, but the trim wire 3 will lie directly on the surface 22 of the separation roll 1. In the case of such a mounting of the trim wire 3 on the separation roll 1, the recommendation is naturally to employ a trim wire 3 spiral, wherein the ratio of the inside diameter of which to the diameter of the receiving surface 210 is less than 1. That is, because of the smaller diameter of the windings of the trim wire 3, the trim wire 3 lies on the surface 22 (i.e. reception surface 210) with such tension that this tension is sufficient to bring about a secure fastening of the trim wire 3 on the separation roll 1. Upon the installation, that is the mounting, of the trim wire 3 onto the separation roll 1, care is taken through appropriate means that the spatial interval of the single windings of the trim wire 3 is at a desired value. Particularly favorable and in accord with a further embodiment of the invention, the separating roll can be so designed that in the area of the mid point between the flanges, the trim wire can be laid with less space between the neighboring windings than is the case in proximity to the flanges 41 and 42, where, as is known, upon the entry of a fiber string, fewer fibers are presented for combing out by the separation roll.

The placement of the neighboring windings with lesser spacing in axial direction is presented in FIG. 2, which shows the trim wire distribution on the separation roll. This is advantageous and is not negated by the fact that the cylindrical surface 22, without possessing any grooving, substitutes for the recess 210 for the trim wire 3. This arrangement is easily carried out in the case of a separation roll as FIG. 2 shows.

By means of the sufficient tension of the trim wire 3 around the separation roll 1, a secure grip of the trim wire 3 is assured, even in the case of a reception surface 210 without grooving. At the same time, the possibility is offered in the same embodiment through different installation means for the trim wire 3 on the separation roll 1 to produce different interval spacings of the windings in a simple manner. The front side 20 of the trim wire 3, which forms the start end of the trim wire 3 wound in the direction of rotation, causes no disturbances in the separation of the fiber strings. This side 20 can be recessed in a direction toward the turning axis of the separation roll 1 into a slot 211 of the surface 210. Another possibility lies in bringing the front surface 20 of the trim wire 3 into proximity of the facing flange 42 side or even axially recessing into said flange. The trailing end of the trim wire 3, on the other hand, can simply lie on the surface 22 of the separation roll 1, since this forms no disturbance point.

On the basis that the cover 4 can be removed from the separation roll 1, the trim wire 3 can advantageously be pushed onto the reception surface 210 of the separation roll 1 without the necessity that upon mounting it must be expanded. By this means, it is possible to design the trim wire 3 with an especially small inside diameter in contrast to the diameter of the surface 210, without endangering the coating.

At the same time, the diameters with such a ratio, say with the value of 1.1 to 0.9, forms an assurance that the trim wire 3 has a firm grip on the separation roll 1 and, during the operation of the separation roll 1, is not further moved. If a separation roll is employed which, for instance, is machined out of one piece and possesses two rigid flanges, care should be taken upon assembly that the trim wire 3 must be lifted clear of the outside diameter of the flange and thereby a larger expansion of the spiral is necessary. This expanding must be within the allowed limits of the deforming of the coating.

In the area near the flange 42, the separation roll 1 possesses on its outer surface 22 a slot 211 in which, as described, the start of the trim wire 3 is recessed. So that the trim wire 3, with its front surface 20, is inserted far enough in the slot 211, the start of the trim wire 3 can be subsequently deformed. In this case, any damage arising to the coating is not of great importance, since in this zone the trim wire 3 does not come into contact with fiber strings. As an additional safety measure, or to lessen the fissure between the trim wire 3 and the receiving surface 210, there can still be applied a caulking compound or an adhesive. This is particularly favorable when the start of the trim wire 3 is even recessed into a groove on the separation roll 1. In this case, the recessed trim wire start 20 should be laid as close as possible to the proximal flange, in FIG. 2 this being flange 42.

Figure 3:
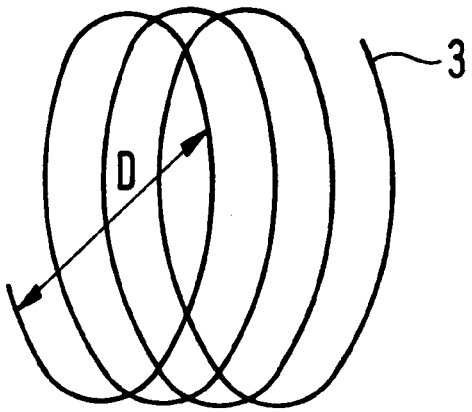
FIG. 3 shows a schematic presentation of a spiral shaped winding of the trim wire in accord with the invention.

FIG. 3, illustrates schematically a presentation of a trim wire 3 produced in accord with the process of the invention. Only four windings are shown as an example, although in accord with the state of the technology, eight to thirteen winding are required for a separation roll in accordance with the breadth of the desired teeth-set and the outer surface of the separation roll. The inside diameter D of the prewound trim wire 3 shows at the same time the governing measurement which is necessary for the allowable elastic deformation of the trim wire upon mounting.

The trim wire 3, preshaped and coated in accord with the invention as shown in FIG. 3, can, upon manufacture, be produced with a greatly increased number of windings than are required for one separation roll. The number of windings is essentially limited by the degree of manipulation permitted by the preworked trim wire. FIG. 3 shows a trim wire 3 which is preformed radially, that is, in spiral shape, as well as pulled out in the axial direction, so that the trim wire 3 practically already is axially fitted to the groove 21 of the separation roll (see FIG. 1). This is, however, not a requirement in every case, since an extension of the trim wire 3 in the axial direction means only a very small degree of deformation, which has practically no effect on the coating.

If the single windings lie against one another in an axial direction after the radial preshaping, then it is a case of necessity to take care that the coating bath has access freely to all sides of the trim wire 3. corresponding care is to be given to other coating procedures.

However, it can be advantageous to wind the trim wire 3 on a pin, with care being taken that the interval spacing of the single windings is so great that the coating can take place on all sides without problem. As a winding body, cylindrical forms are suitable with a greater diameter than the diameter D and which have characteristics which do not interfere with the coating. Among the known coating procedures, including a nickel coating which is deposited out of a chemical bath, no special measures are required. Since, in accord with the invention, now only the trim wire 3 itself is to be coated, other coating processes in accord with the invention, for instance nitriding or boriding, or yet other methods are possible, even coating procedures at high temperatures since, the core body, that is, the separation roll itself is not subjected to the coating process. This enables a much greater pallette of improvements on the application of teeth to the separation roll than were known up to this time in the conventional state of the technology. Further, it is possible now, following the deformation of the trim wire 3, to run through a hardening process before or after the coating. This is advantageously possible since, for the mounting of the trim wire, this need be only deformed a small amount so that even deep hardened trim wires can find application for the separation roll in accord with the invention. Even a plasma coating of the trim wire 3, or for instance the teeth, or part of the teeth, is now possible without great expense. The process in accord with the invention is now independent of the raw materials of the trim wire 3 and permits the use of materials, which up to now, were unusable for the separation roll itself.

It should be apparent to those skilled in the art that various modifications and variations can be made in the present invention without departing from the scope of the invention. It is intended that the invention include such modifications and variations as come within the scope of the appended claims and their equivalents.

What is claimed is:

1. A separating roll for separation of fibers in an open-end spinning machine, said separating roll comprising a cylindrical carrier having an outer circumferential surface carrying a tooth set thereon, said tooth set further comprising a trim wire having teeth thereon, wherein said trim wire is preformed into a predetermined shape having axially spaced apart spiral windings with said teeth projecting radially outward from said windings, and said trim wire coated with an abrasion resistant coating after being preformed, and wherein said trim wire was hardened after said preforming either before or after being coated.

2. The separating roll as in claim 1, wherein said carrier defines a receiving recess of a given diameter for said trim wire, said spiral shaped trim wire having an inside diameter generally at least equal to said given diameter of said receiving recess.

3. The separating roll as in claim 1, wherein said carrier defines a receiving recess of a given diameter for said trim wire, said spiral shaped trim wire having an inside diameter generally less than said given diameter of said receiving recess.

4. The separating roll as in claim 1, wherein said carrier defines a receiving recess of a given diameter for said trim wire, said spiral shaped trim wire having an inside diameter wherein a ratio of said trim wire inside diameter to said given diameter of said receiving recess is generally less than about 1.4.

5. The separating roll as in claim 1, wherein said carrier defines a receiving recess of a given diameter for said trim wire, said spiral shaped trim wire having an inside diameter wherein a ratio of said trim wire inside diameter to said given diameter of said receiving recess is generally between 1.2 and 0.8.

6. The separating roll as in claim 1, wherein said carrier defines a receiving recess of a given diameter for said trim wire, said spiral shaped trim wire having an inside diameter wherein a ratio of said trim wire inside diameter to said given diameter of said receiving recess is generally between 1.1 and 0.9.

7. The separating roll as in claim 1, wherein said trim wire is also heat treated prior to attachment thereof to said carrier.

8. The separating roll as in claim 1, wherein said carrier defines a receiving recess of a given diameter for said trim wire, said receiving recess comprising an essentially flat surface on said outer circumferential surface of said carrier upon which said trim wire is laid.

9. The separating roll as in claim 1, wherein said carrier defines a receiving recess of a given diameter for said trim wire, said receiving recess comprising a continuous groove defined into said outer circumferential surface of said carrier into which said trim wire is inserted.

10. The separating roll as in claim 9, wherein said groove comprises a width that is greater than an axial width of said trim wire and generally less than said axial width of said trim wire plus 0.2 mm.

11. The separating roll as in claim 1, wherein said carrier comprises a flange, said trim wire comprising an end connected to said flange.

12. The separating roll as in claim 1, wherein said trim wire comprises a coating having granulated hard bodies embedded therein.

13. The separating roll as in claim 12, wherein said coating is comprised of one of a boride or a nitride.

14. A process for producing a separating roll for an open-end spinning machine, said process comprising forming teeth on a surface of a trim wire; preforming the trim wire into a spiral shape it will generally assume on a carrier of the separating roll with the teeth projecting radially outward from the spiraled wire and with a predetermined axial distance between individual windings thereof; coating the spiral shaped trim wire with an abrasion resistant coating; hardening the trim wire after said preforming and before or after said coating; and winding the spiral shaped and coated trim wire onto an outer circumferential surface of a carrier.

15. The process as in claim 14, wherein said hardening the trim wire takes place prior to winding the trim wire onto the carrier.

16. The process as in claim 14, comprising winding the spiral shaped trim wire on a winding body prior to said coating.

17. The process as in claim 14, wherein said coating comprises immersing the trim wire in a nickel composition chemical bath.

18. The process as in claim 17, wherein the chemical bath includes hard particulate grains that become embedded in the coating.

19. The process as in claim 14, wherein said coating comprises a nitriding process for the trim wire.

20. The process as in claim 14, wherein said coating comprises a boriding process for the trim wire.

21. A process for producing a separating roll for an open-end spinning machine, said process comprising forming teeth on a surface of a trim wire; preforming the trim wire into a spiral shape with a predetermined axial distance between individual windings thereof; coating the spiral shaped trim wire with an abrasion resistant coating by immersing the trim wire in a nickel composition chemical bath; heat treating the trim wire after said immersion in the chemical bath; and winding the spiral shaped and coated trim wire onto an outer circumferential surface of a carrier.

22. A process for producing a separating roll for an open-end spinning machine, said process comprising forming teeth on a surface of a trim wire; preforming the trim wire into a spiral shape with a predetermined axial distance between individual windings thereof; coating the spiral shaped trim wire with an abrasion resistant coating in a plasma coating process for the trim wire; and winding the spiral shaped and coated trim wire onto an outer circumferential surface of a carrier.

* * * * *